US008453899B1

(12) United States Patent
Calkin

(10) Patent No.: US 8,453,899 B1
(45) Date of Patent: Jun. 4, 2013

(54) QUICK-RELEASE STRAP ATTACHMENT SYSTEM

(75) Inventor: Carston R. Calkin, Tualatin, OR (US)

(73) Assignee: Skedco, Inc., Tualatin, OR (US)

( * ) Notice: Subject to any disclaimer, the term of this patent is extended or adjusted under 35 U.S.C. 154(b) by 0 days.

(21) Appl. No.: 13/535,141

(22) Filed: Jun. 27, 2012

Related U.S. Application Data

(60) Provisional application No. 61/501,645, filed on Jun. 27, 2011.

(51) Int. Cl.
*A45F 5/00* (2006.01)

(52) U.S. Cl.
USPC ..... 224/675

(58) Field of Classification Search
USPC ..... 224/675; 24/3.7; 2/102
See application file for complete search history.

(56) References Cited

U.S. PATENT DOCUMENTS 5,259,093 A * 11/1993 D'Annunzio ..... 24/3.9
5,724,707 A * 3/1998 Kirk et al. ..... 24/3.7
6,206,567 B1 * 3/2001 Cyr ..... 383/29
6,948,188 B2 9/2005 D'Annunzio
7,240,404 B2 * 7/2007 Flossner ..... 24/3.7
7,526,842 B2 5/2009 Wemmer
7,694,862 B2 * 4/2010 Bergeron ..... 224/665
7,963,427 B2 6/2011 Calkin
8,002,159 B2 * 8/2011 Cragg ..... 224/579
2005/0015944 A1 * 1/2005 Bergeron ..... 24/584.1

OTHER PUBLICATIONS combatreform.org, Jumble of straps: the Harness, Single-Point Release (HSPR); http://combatreform.org/hspr.htm; published at least as early as Sep. 12, 2009.

* cited by examiner

*Primary Examiner* — Justin Larson
(74) *Attorney, Agent, or Firm* — Stoel Rives LLP

(57) ABSTRACT

Disclosed is are quick-release strap attachment features for releasably securing an article to a support surface. The system includes securement straps, which may be PALS webbing, and includes an elongate and flexible connector strap with a pull end that, when pulled away from an endmost securement strap of the article, causes the connector strap to be withdrawn from a loop channel to release the article from the support surface.

20 Claims, 12 Drawing Sheets

QUICK-RELEASE STRAP ATTACHMENT SYSTEM

RELATED APPLICATIONS

This application claims the benefit under 35 U.S.C. §119 (e) from U.S. Provisional Patent Application No. 61/501,645, filed Jun. 27, 2011, which is herein incorporated by reference in its entirety.

TECHNICAL FIELD

The present disclosure relates to strap-type connector systems for releasably securing pocket members, pouches, holsters, or other articles onto supporting articles such as backpacks, luggage, jackets, vests, garments, or other supporting structures, and more particularly to such strap attachment arrangements that releasably secure a removable first article to a supporting second article by interweaving individual, flexible strap member components secured to the first or second articles.

BACKGROUND INFORMATION

Previous strap-type attachment apparatuses and fastening systems for releasably securing an article to a supporting article have been discussed in U.S. Patent Application Pub. No. 2007/0158380 of Calkin. Strap-type attachment arrangements are desirable because they provide an extremely strong yet flexible attachment for various pocket-type members onto garments or articles worn or carried by persons such as military personnel, emergency and rescue personnel, hunters, anglers, or climbers, to name just a few examples. Removable articles in the form of pocket members or pouches are used to hold handguns, ammunition clips, grenades, medical supplies, canteens, and many other types of supplies or gear suited for particular field functions. The strap-type attachment arrangements are modular systems that permit removal and exchange of alternate sizes, types, or arrangements of the pouch members as may be desired, as well as permitting the desired repositioning of the pocket members on the supporting article to suit the purpose of the wearer. In combat or in other emergencies, slow, confusing, or cumbersome removal of the pouches can present serious problems for the user, particularly when speed and simplicity are imperative for the user's safety or the safety of others.

SUMMARY

A releasable connector strap system for releasably securing a removable strap-type attachment article to a support strap-type structure, which includes spaced apart and elongated connector strap segments anchored to one side of the removable strap-type attachment article, and a pull handle segment affixed to a distal end of the elongated connector strap segments, proximal to the one side of the removable strap-type attachment article. In another embodiment, a retaining pouch is positioned to receive and releasably retain terminal ends of the connector strap segments, for retaining the terminal ends when the connector strap segments interlock the support strap-type structure to the removable strap-type attachment article.

Additional aspects and advantages will be apparent from the following detailed description of preferred embodiments, which proceeds with reference to the accompanying drawings.

DETAILED DESCRIPTION OF PREFERRED EMBODIMENTS

For purposes of clarity and ease of description, opposing surfaces of example quick-release strap-type attachment articles discussed below include top and bottom, face and rear, and hinge-side and entry-side surfaces. The terms "top" and "bottom" of a removable strap-type attachment article (or simply "article") correspond to lateral surfaces that are parallel to the ground when the article is secured to an upright support structure, such that the top surface is farthest from the ground. The "face" and "rear" of a strap-type attachment article correspond to the respective exposed and concealable major longitudinal surfaces, with the concealable surface including an interlocking system of webbing described below. The hinge-side and entry-side surfaces include the two remaining opposing longitudinal surfaces that may be perpendicular to the ground. Skilled persons will recognize that the designations of these surfaces are arbitrary and are simply intended to facilitate a frame of reference for the examples of strap-type attachment articles discussed below. In other words, the article may be attached in any orientation, e.g., with the lateral and longitudinal sides transposed, or the entry- and hinge-sides may correspond to the top and bottom the article. Related parts discussed herein share identical reference numbers.

Figure 1A:
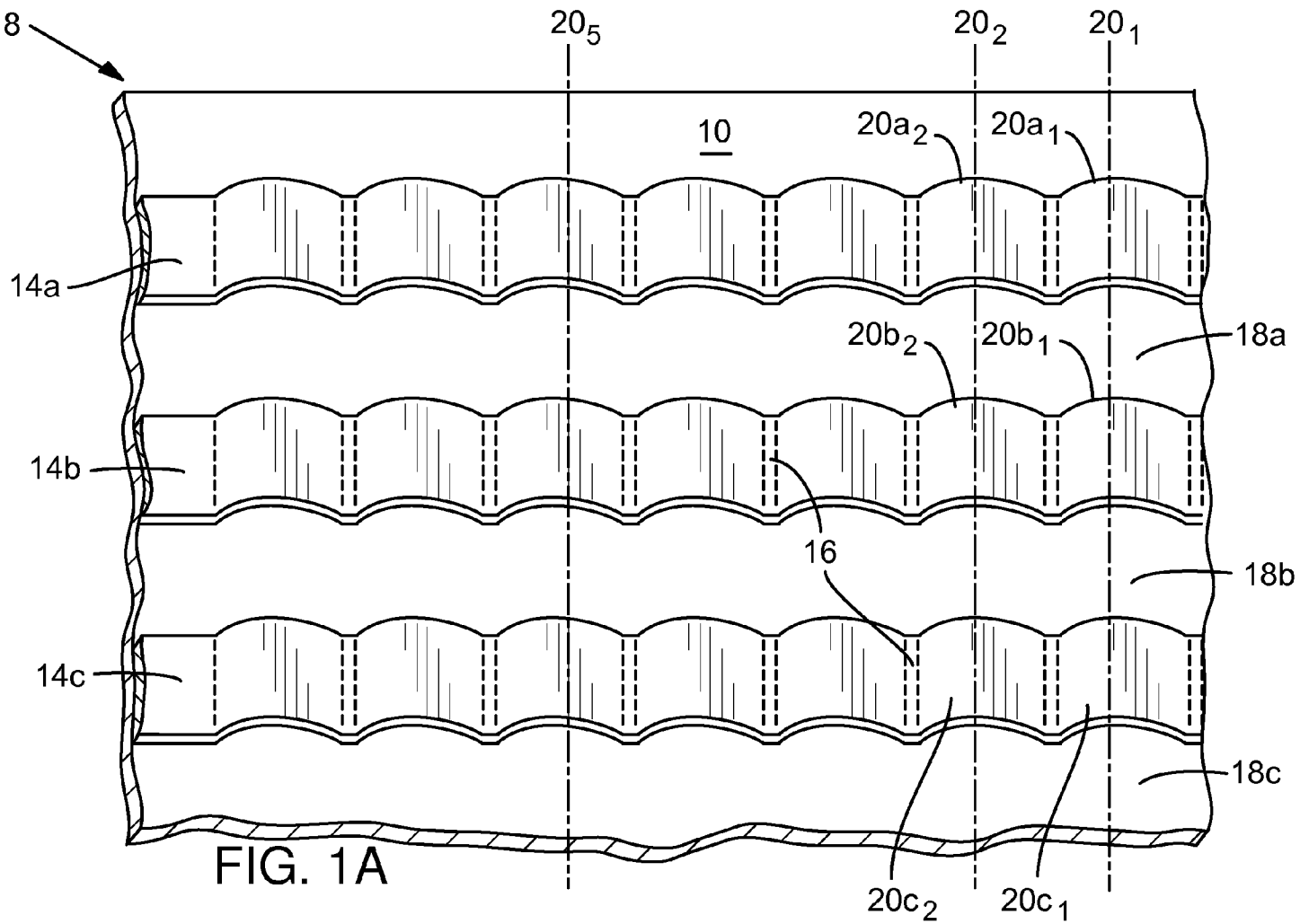
FIG. 1A is an isometric view of a support article fragment including three securement straps on a base surface, according to one embodiment.
Figure 1B:
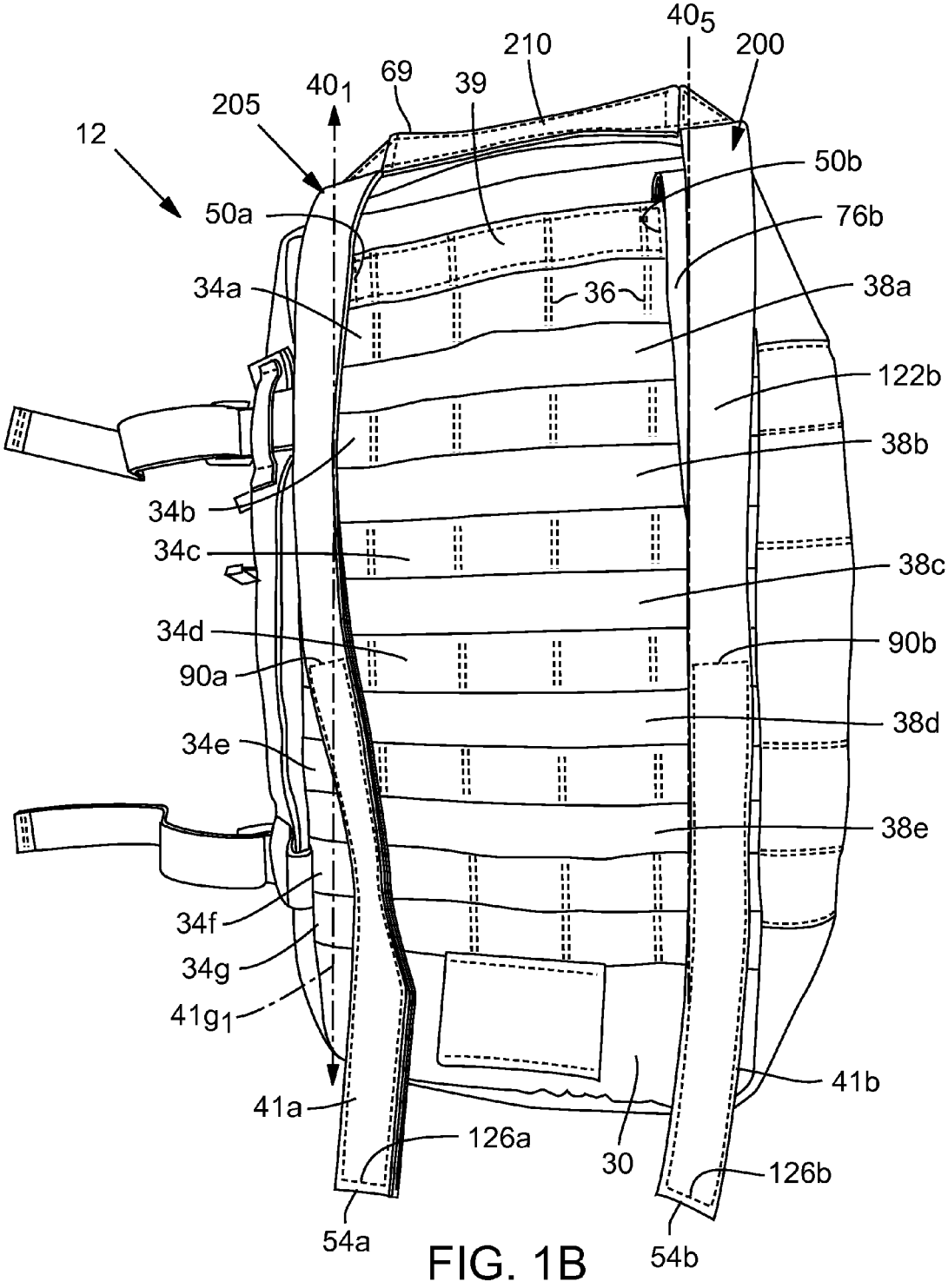
FIG. 1B is a perspective view of a rear panel of a medical chest bag having quick-release connector straps and a pull handle segment, according to a first embodiment.

Referring to the embodiment shown in FIGS. 1A and 1B, a panel portion of a base (or support) article 8 includes a base (or mounting) surface 10, which may be an external panel surface of any supporting article such as a bag, a backpack, a jacket, a vest or other garment, a piece of luggage, or other supporting article. The base surface 10 is a panel portion of flexible fabric material such as canvas, nylon, or other material suitable for the purpose of the base article 8. The base surface 10 is configured to releasably receive and securely mount a separate, removable, overlying article such as a pocket member or other removable article represented herein by a medical chest bag 12 (FIG. 1B).

The base surface 10 includes a plurality of laterally extending, laterally elongated securement straps 14*a*-14*c* (collectively, 14) secured to the base surface 10 by suitable means such as by sewing or stitching 16. The securement straps (or web members) 14 are formed of flexible, lightweight material such as nylon webbing material that is well known for its strength, durability, and resistance to wear or breaking. In some embodiments, other suitable fabric materials may be used for the securement straps 14. Although three securement straps 14*a*-14*c* are depicted on the fragment of the base surface 10, a greater or fewer number of the securement straps 14 are possible.

Each of the laterally extending securement straps 14*a*-14*c* is arranged on the underlying base surface 10 in a longitudinally spaced apart manner having spaces 18*a*-18*c* (collectively, 18) therebetween. The longitudinal spaces 18*a*-18*c* have widths approximately equal to the widths of the securement straps 14*a*-14*c*, although various securement strap widths and longitudinal space widths are contemplated and within the scope of the present disclosure, e.g., unequal or variable widths. According to one embodiment, longitudinal spaces 18 are sufficiently wide to accommodate confronting securement straps of various removable articles in accordance with the Pouch Attachment Ladder System (PALS).

The securement straps 14 are secured on the base surface 10 by sewing or stitching 16 in a looped manner that provides at least one longitudinally aligned column of open loops or securement loop channels $\mathbf{20}_j$ (collectively, 20), where subscript j denotes a particular channel column, i.e., 1-7 in the example support article 8. Individual loops are identified by an additional reference letter (a, b, or c) to indicate the corresponding securement strap 14*a*, 14*b*, or 14*c*. For example, the first column of open loops (or loop channel) $\mathbf{20}_1$ is identified by a dotted line and includes loops $\mathbf{20}a_1$, $\mathbf{20}b_1$, and $\mathbf{20}c_1$; the second column $\mathbf{20}_2$ includes loops $\mathbf{20}a_2$, $\mathbf{20}b_2$, and $\mathbf{20}c_2$; and so on. Skilled persons will recognize that the width of the loop channels 20, as well as the distance between adjacent loop channels, may vary and may depend on the particular field use of the bag 12. Furthermore, a loop means a structure—alone or in combination with another structure—that enfolds or encircles an aperture.

With reference to FIG. 1B, the bag 12 includes a rear attachment surface (or rear side panel) 30, with webbing or securement straps 34*a*-34*g* (collectively, 34) substantially similar to the PALS-type arrangement of the securement straps 14, described above. The laterally elongated, laterally extending securement straps 34 are secured to the bag 12 by stitching 36 and are positioned in a longitudinally spaced apart condition with spaces 38 therebetween.

Figure 2A:
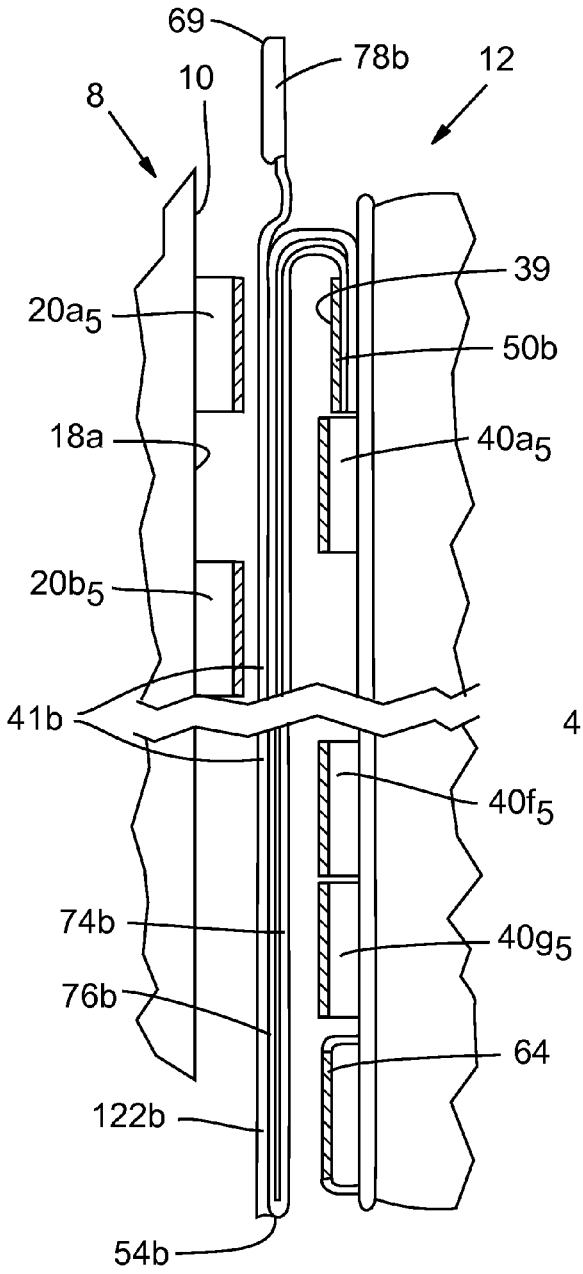
FIGS. 2A and 2B are sectional views showing fragments of a support article and a bag with a quick-release connector strap therebetween in respective separated and interlocking conditions.
Figure 2B:
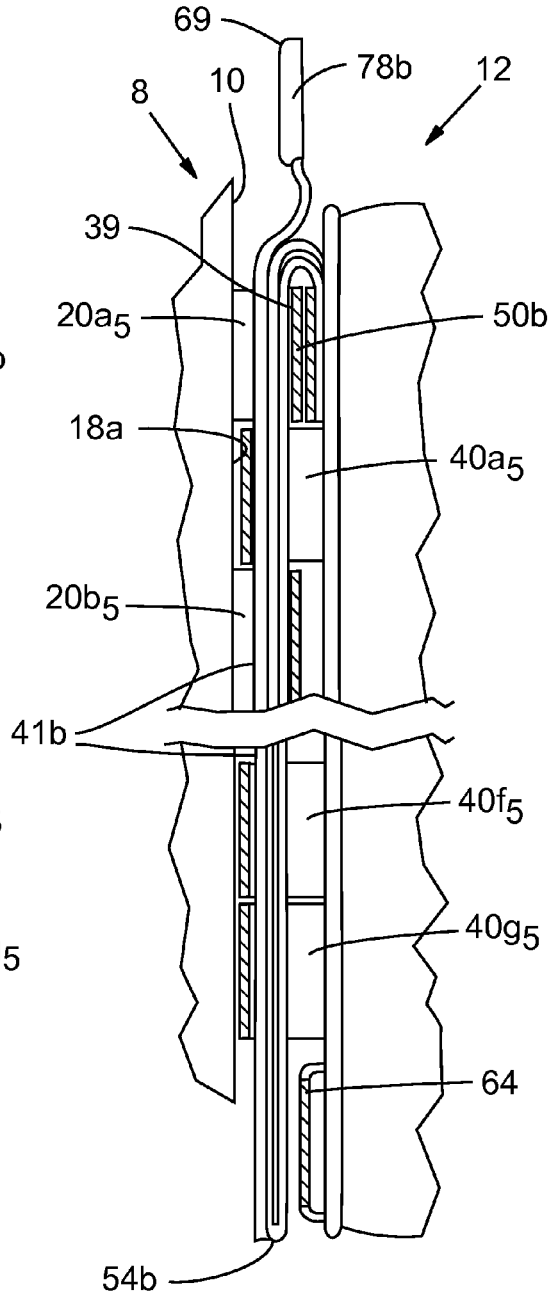

The securement straps 34 are positioned on the bag 12 so that when the rear attachment surface 30 confronts the base surface 10, the securement straps 34 generally confront the corresponding spaces 18, and the securement straps 14 generally confront the corresponding spaces 38. For example, the securement strap 34*a* aligns and confronts with the base surface 10 in the space 18*a*; the securement strap 14*b* aligns and confronts with the rear attachment surface 30 in the space 38*a*; and so on. The securement strap 14*a* aligns and confronts a laterally elongated webbing backing 39 that is stitched into the rear attachment surface 30 adjacent to the securement strap 34*a*. The webbing backing 39 provides additional thickness that helps to maintain a tight connection between the initial securement strap 14*a* and the bag 12 (as depicted in FIG. 2B) to reduce inadvertent loosening of the bag 12.

The bag 12 of the illustrated embodiment is attached to a base surface 10 having six or more securement straps 14, i.e., a securement strap 14*a* to align with the webbing backing 39, and five other securement straps 14 to align with each of the spaces 38*a*-38*e*. However, skilled persons will recognize that the bag 12 may be attached to a base surface 10 having fewer than six securement straps. For example, the three securement straps 14*a*-14*c* may be provided to align with intermediate spaces 38*b*-38*d*. In another embodiment, two securement straps (not shown) may be provided to align with the endmost spaces 38*a* and 38*e*. In other words, the total number and position of the securement straps 14 or 34 may vary.

Similar to the securement straps 14 of the support article 8, the securement straps 34 of the bag 12 also provide open loops aligned to form loop channels 40. As described below with respect to FIGS. 2A and 2B, the loop channels 20 and 40 may be aligned and interlaced so that the securement straps 14 and 34 may be interwoven with one or more connector straps 41*a* and 41*b* (FIG. 1B) for releasably securing the bag 12 in a confronting condition against the base surface 10. For example, a combined loop channel may be formed from the loops $\mathbf{40}a_1$, $\mathbf{40}b_1$, and $\mathbf{40}c_1$, aligned and interlaced with the loops $\mathbf{20}a_1$, $\mathbf{20}b_1$, and $\mathbf{20}c_1$, respectively. Likewise, the loops $\mathbf{40}a_5$, $\mathbf{40}b_5$, and $\mathbf{40}c_5$, may be aligned and interlaced with the loops $\mathbf{20}a_5$, $\mathbf{20}b_5$, and $\mathbf{20}c_5$, respectively, as illustrated in FIG. 2B.

Although occluded in FIG. 1B, the rear side panel 30 of the bag 12 includes laterally spaced apart fastener stitching 50*a* and 50*b*, more clearly visible in other embodiments shown in FIGS. 7-10. The fastener stitching 50*a* and 50*b* of the bag 12 are box stitches that anchor, respectively, the first and second longitudinally extending, elongated connector straps 41*a* and 41*b* (collectively, 41). According to some embodiments, rivets, stitching, or other suitable securing means may be used for anchoring connector straps 41*a* and 41*b* to the bag 12 or to the support article 8.

As shown in FIG. 1B, the connector straps 41*a* and 41*b* are secured to the bag 12 in laterally spaced apart position, disposed for threading through respective aligned loop channel pairs $\mathbf{20}_1$, $\mathbf{40}_1$, and $\mathbf{20}_5$, $\mathbf{40}_5$. The positioning of the longitudinally elongated connector straps 41 in alignment with the respective pairs of laterally spaced, longitudinally aligning loop channels $\mathbf{20}_1$, $\mathbf{40}_1$ and $\mathbf{20}_5$, $\mathbf{40}_5$ permits weaving of the connector straps 41 through the aligned loop channels in an alternating, longitudinal progression, interlocking the securement straps 14 and 34 with the connector straps 41, and thereby removably securing the bag 12 to the support article 8. For example, as shown in FIGS. 2A and 2B, a free or terminal end portion 54*b* may be directed longitudinally into, through, and out of the opposite opening of an open loop $\mathbf{20}a_5$. The free end 54*b* may then be directed into, through, and out of the opening of the corresponding open loop $\mathbf{40}a_5$, and then be directed in similar manner through the remaining longitudinally aligned loops of securement straps 14*b*, 34*b*, and so forth, until the free end 54*b* exits the loop 40$g_5$. The above interweaving process is then repeated with the other connector strap 41*a* thereby interlocking the loop channels 20$_1$ and 40$_1$ and securing the bag 12 to the support article 8.

Figure 3:
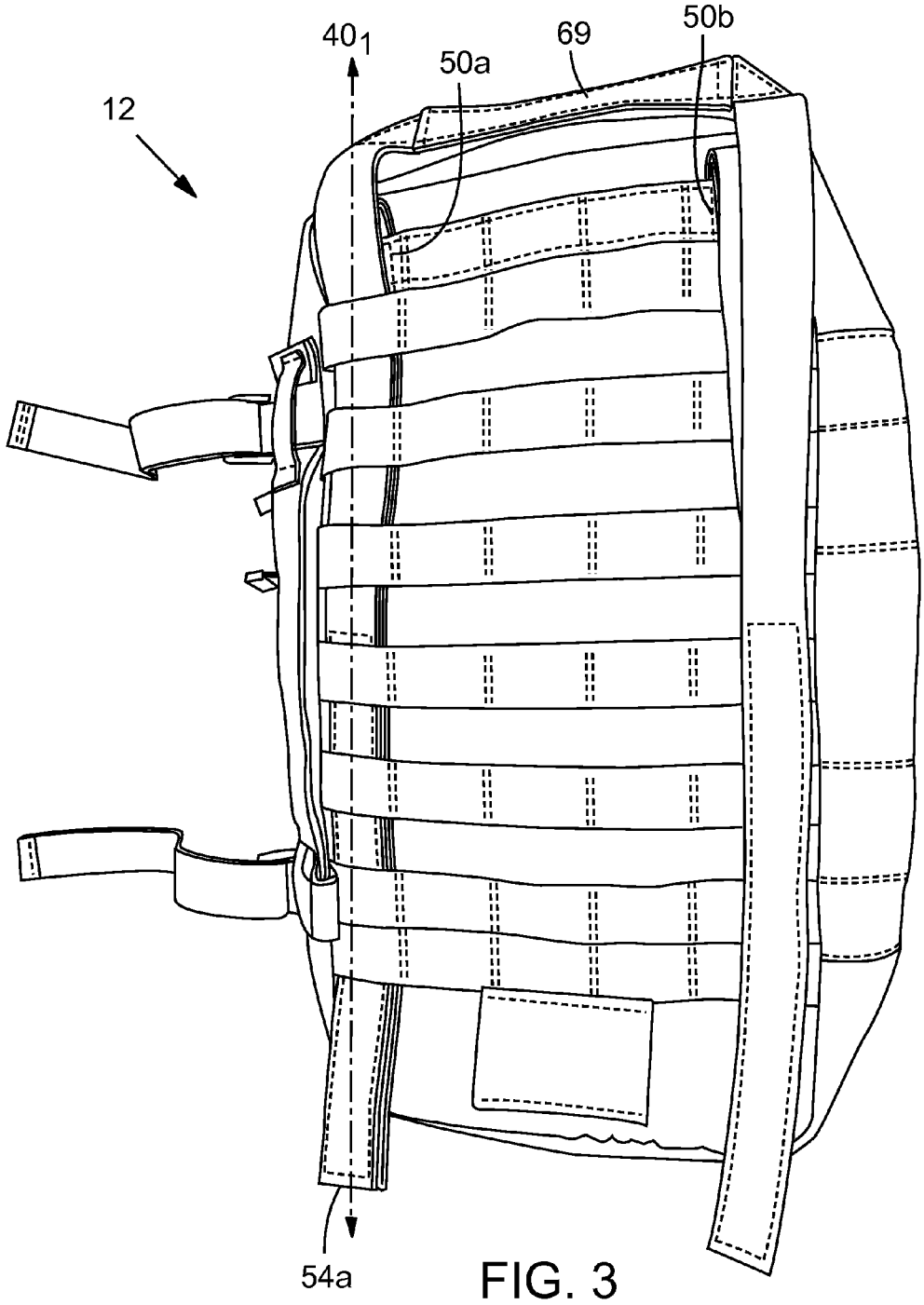
FIG. 3 is a perspective view of the rear panel as shown in FIG. 1B, with one quick-release connector strap threaded through a loop channel.
Figure 4:
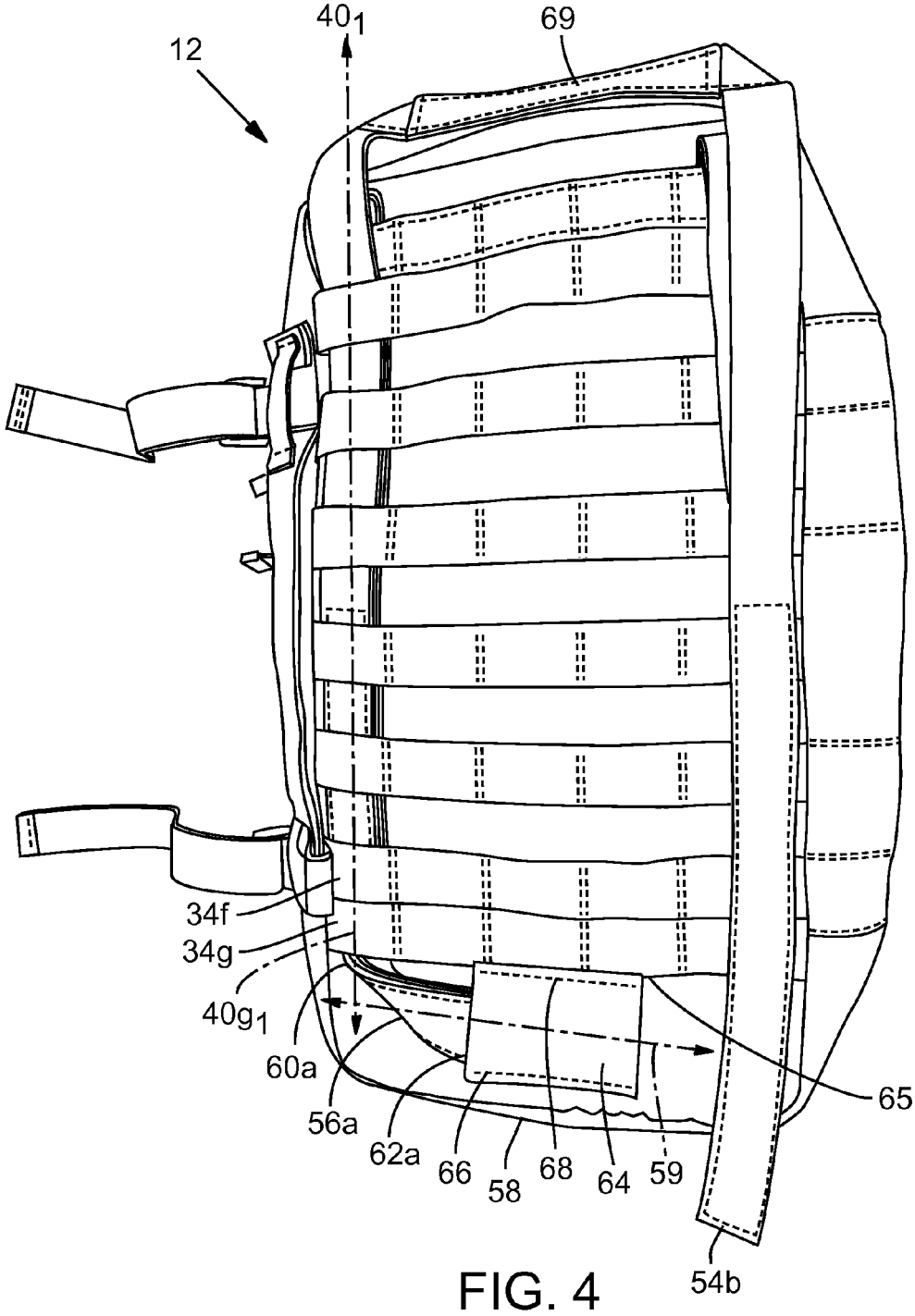
FIG. 4 is a perspective view of the rear panel as shown in FIG. 1B, with a terminal end of the threaded quick-release connector strap folded and tucked into a side opening of a retaining member.
Figure 5:
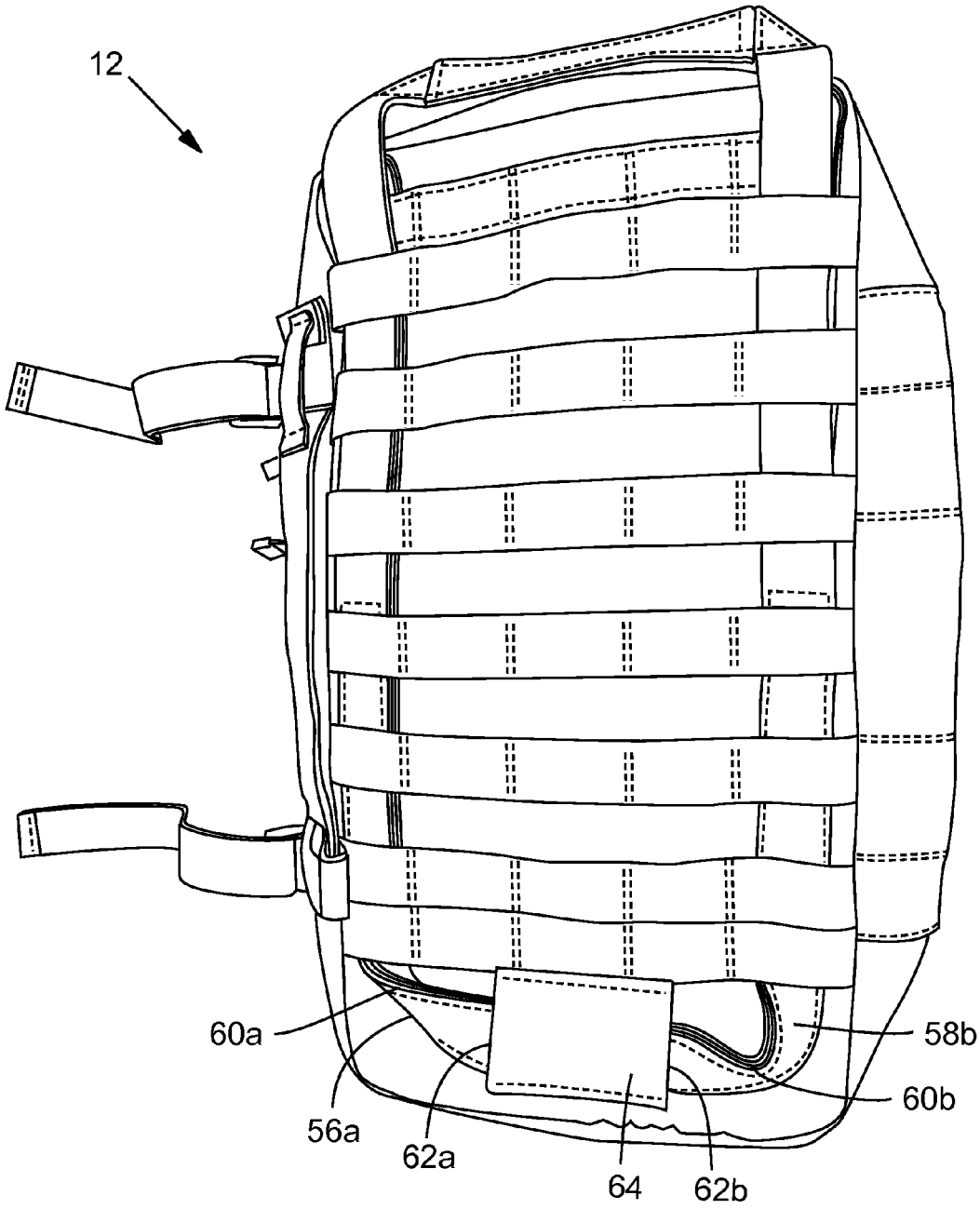
FIG. 5 is a perspective view of the rear panel as in FIG. 1B, showing both threaded quick-release connector strap terminal ends folded into opposing side openings of the retaining member.
Figure 6:
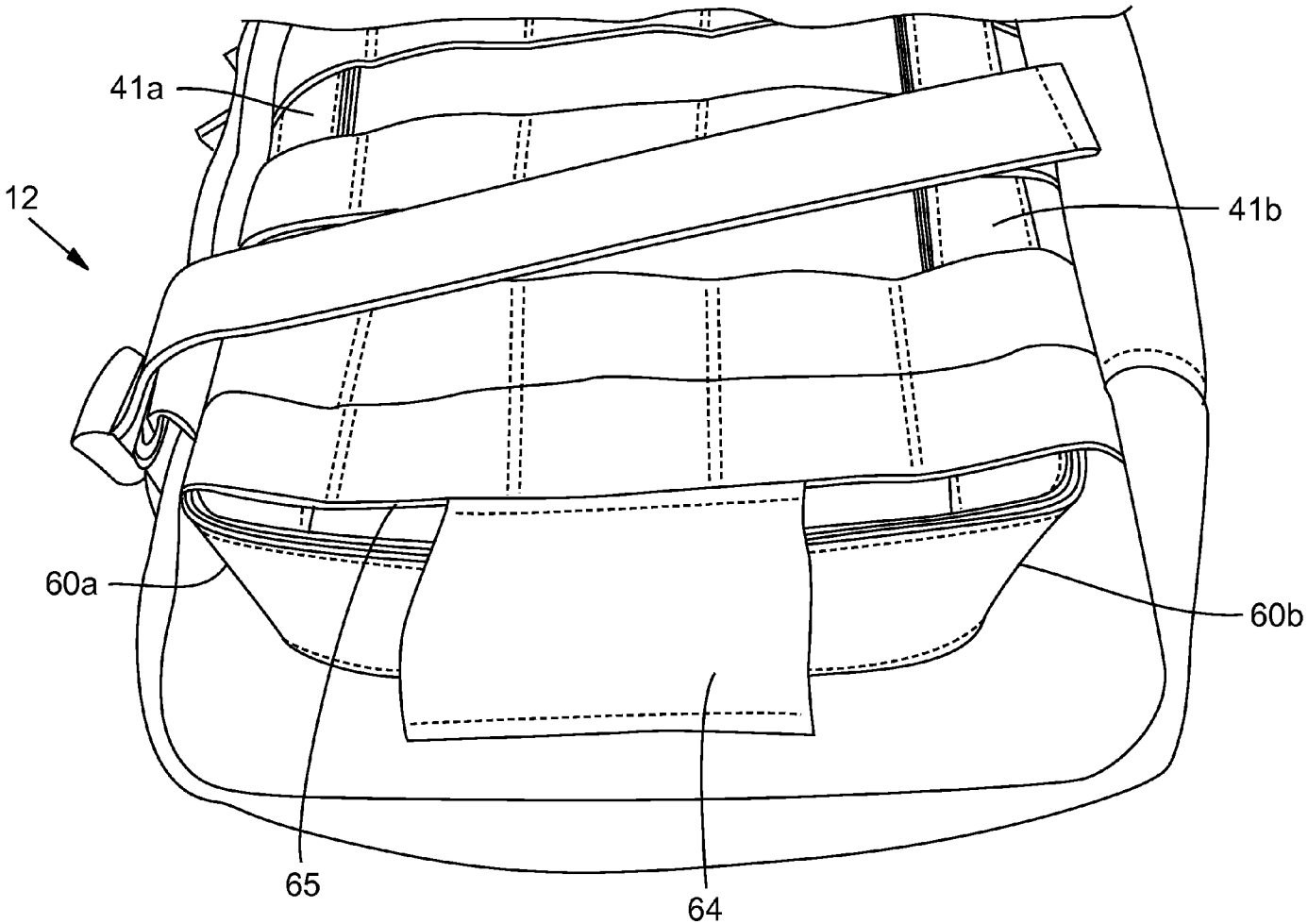
FIG. 6 is an enlarged perspective view of rear and bottom panel surfaces, showing the threaded and tucked quick-release connector straps as depicted in FIG. 5.

FIG. 3 illustrates the connector strap 41*a* threaded through the loop channel 40$_1$ identified by a dotted line axis; however, as noted with respect to FIG. 2B, if the bag 12 were actually secured to the support article 8, the portions of the connector strap 41*a* visible in the spaces 38 between loops would instead be placed though the loop channel 20$_1$. As shown in FIG. 4, after the free end 54*a* (FIG. 3) exits the loop 40$g_1$, a 90° fold 56*a* is placed such that the terminal end 54*a* is brought into general alignment to a bottom-side surface 58 of the bag 12. Because the connector strap 41*a* is constructed of flexible, yet relatively thick and frictional material, folding the connector strap 41*a* proximal to the longitudinally end-most securement strap 34*g* (along an insertion axis 59 that is transverse to axis 40$_1$), produces a raised elbow 60*a*. The terminal end 54*a* may then be tucked under a side opening 62*a* of a retaining member 64, in the form of a pouch. The retaining member 64 is positioned proximal to a bottom-side 65 of the securement strap 34*g* with lateral stitching on two opposing sides 66 and 68. FIG. 5 shows the opposing connector strap 41*b* with the terminal end 54*b* arranged in a similar manner as the connector strap 41*a* in FIG. 5 with the terminal ends 54*a* and 54*b* confronting and tucked into respective opposing side openings 62*a* and 62*b* of the retaining member 64. FIG. 6 includes a close-up perspective view of the retaining member 64 covering the terminal ends 54*a* and 54*b*.

The position of the retaining member 64 relative to the longitudinally end-most securement strap 34*g* helps develop the angle of the folds 56*a* and 56*b*, and thereby imparts the raised elbows 60*a* and 60*b* when the terminal ends 54*a* and 54*b* are tucked into the respective side openings 62*a* and 62*b* of the retaining member 64. In addition, the securement straps 34*g* and 34*f* are adjacent, i.e., without any intermediate space, such that a partial loop channel formed by loops 40$g_1$, 40$f_1$ is two times the longitudinal length of the channel segments formed by other loops. The placement and dimensions of the retaining member 64 forming the raised elbows 60*a* and 60*b*, in conjunction with the longer loop channels formed by securement straps 34*g* and 34*f*, help to prevent the connector straps 41*a* and 41*b* from inadvertently loosening. Nevertheless, the connector straps 41*a* and 41*b* are not so restricted as to prevent quick release of multiple straps, i.e., unweaving or disengaging the connector straps 41*a* and 41*b* from the securement straps 14 and 34 by a strong pull, as discussed in detail below.

Skilled persons will recognize that various retaining member 64 placements or attachments are possible. For example, in another embodiment (not shown), a retaining member 64 can be riveted directly over the securement strap 34*g*, thereby imparting a fold with an included angle between adjacent segments, wherein the included angle is less than 90°. Increasingly acute included angles are potentially less susceptible to loosening but potentially more resilient to release. Conversely, in yet another embodiment, the retaining member 64 may be affixed to a lateral side surface of the bag 12 or the support article 8, or each connector strap 41*a* and 41*b* may have an individual retaining member (not shown). A separately dedicated retaining member is optional, and instead the terminal ends 54*a* and 54*b* may be tucked into securement loops on the support article 8, as described in U.S. Patent Application Pub. No. 2007/0158380 of Calkin, which is assigned to the applicant of the present disclosure.

Various flexible strap-type arrangements and interlocking strap attachment systems have been attempted. Applicants discovered that the previous attempts failed to provide an intuitive and efficient detachment mechanism capable of quickly releasing an attached article. For example, U.S. Pat. No. 5,259,093 of D'Annunzio for Strap Connector discusses a quick-release tab for a single connector strap that requires pulling the tab and the attached article in opposite directions, thereby requiring at least two steps to release a single connector strap. In previous attempts featuring multiple connector straps, each connector strap functioned more or less independently such that each connector strap had to be pulled individually to release an attached article from a support structure. As described below, applicant discovered that a third strap segment (or pull handle segment) 69, joining pullable end portions of the connector straps 41*a* and 41*b* may be used to form a quick-release pull handle for the connector straps 41, thereby allowing multiple connector straps to be readily released simultaneously.

Figure 7:
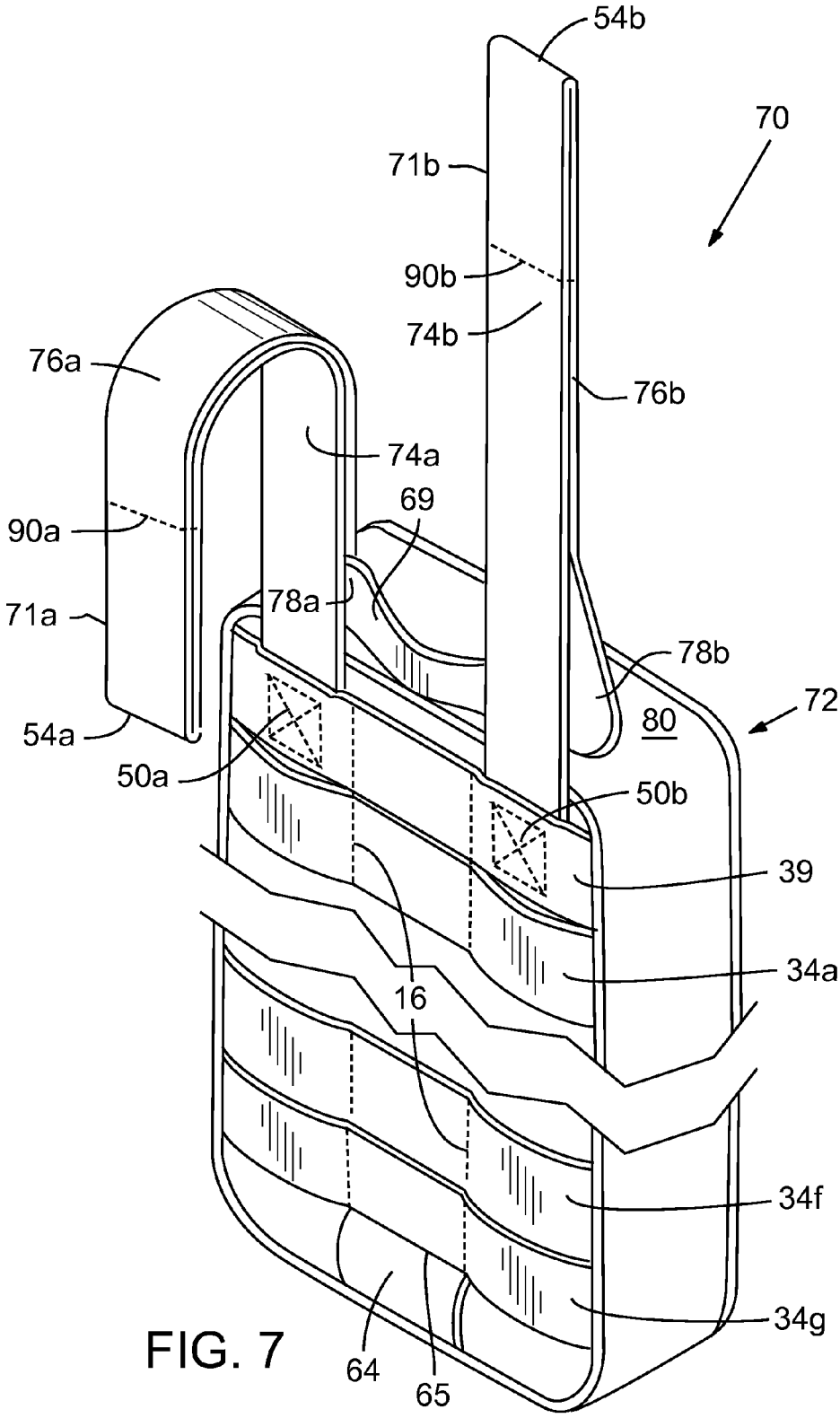
FIG. 7 is an isometric view of a bag having quick-release connector straps with an integral pull handle, according to a second embodiment.
Figure 8:
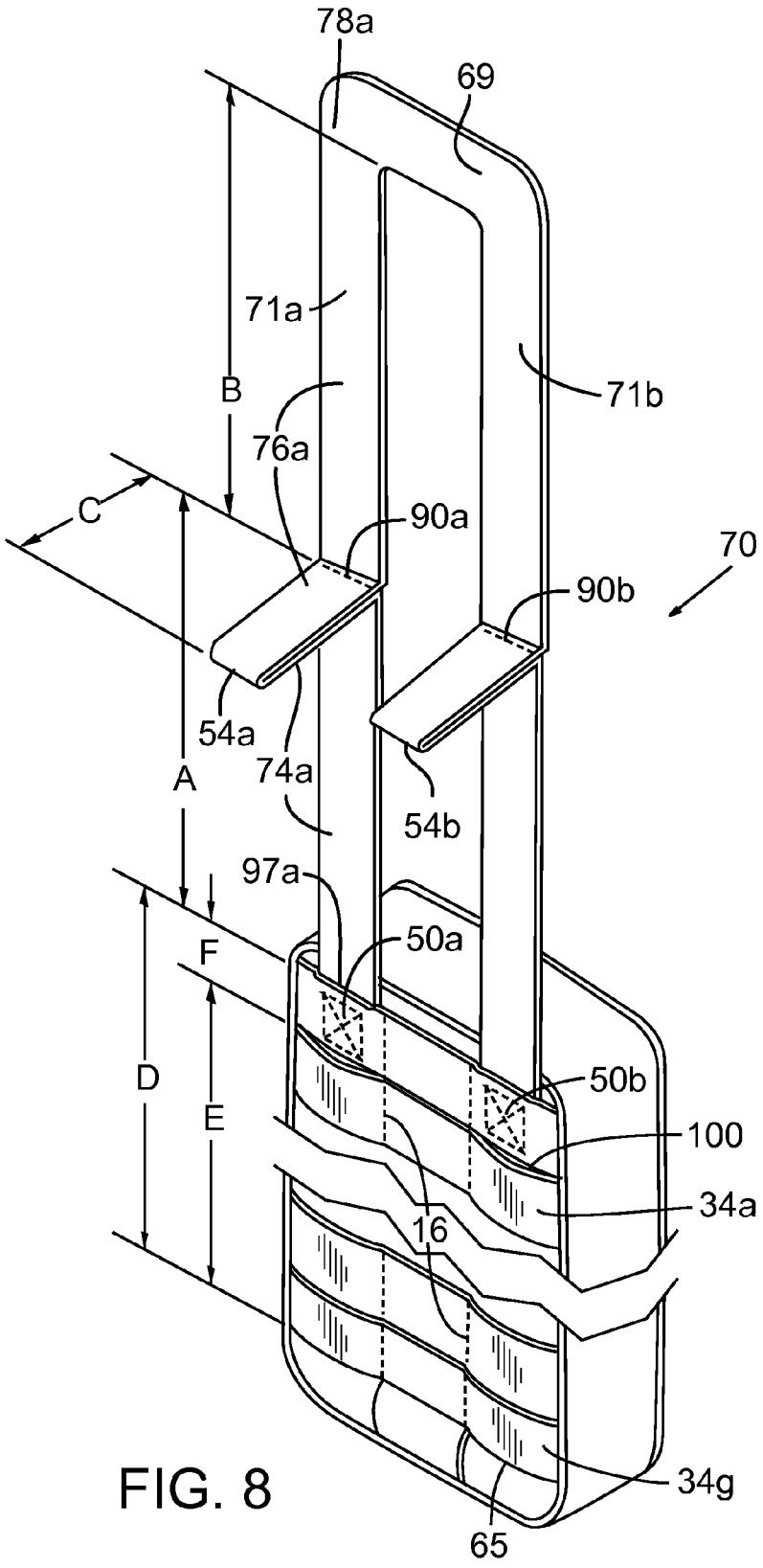
FIG. 8 is an isometric view of the bag of FIG. 7 showing the quick-release connector straps in an extended condition, according to the second embodiment.
Figure 10:
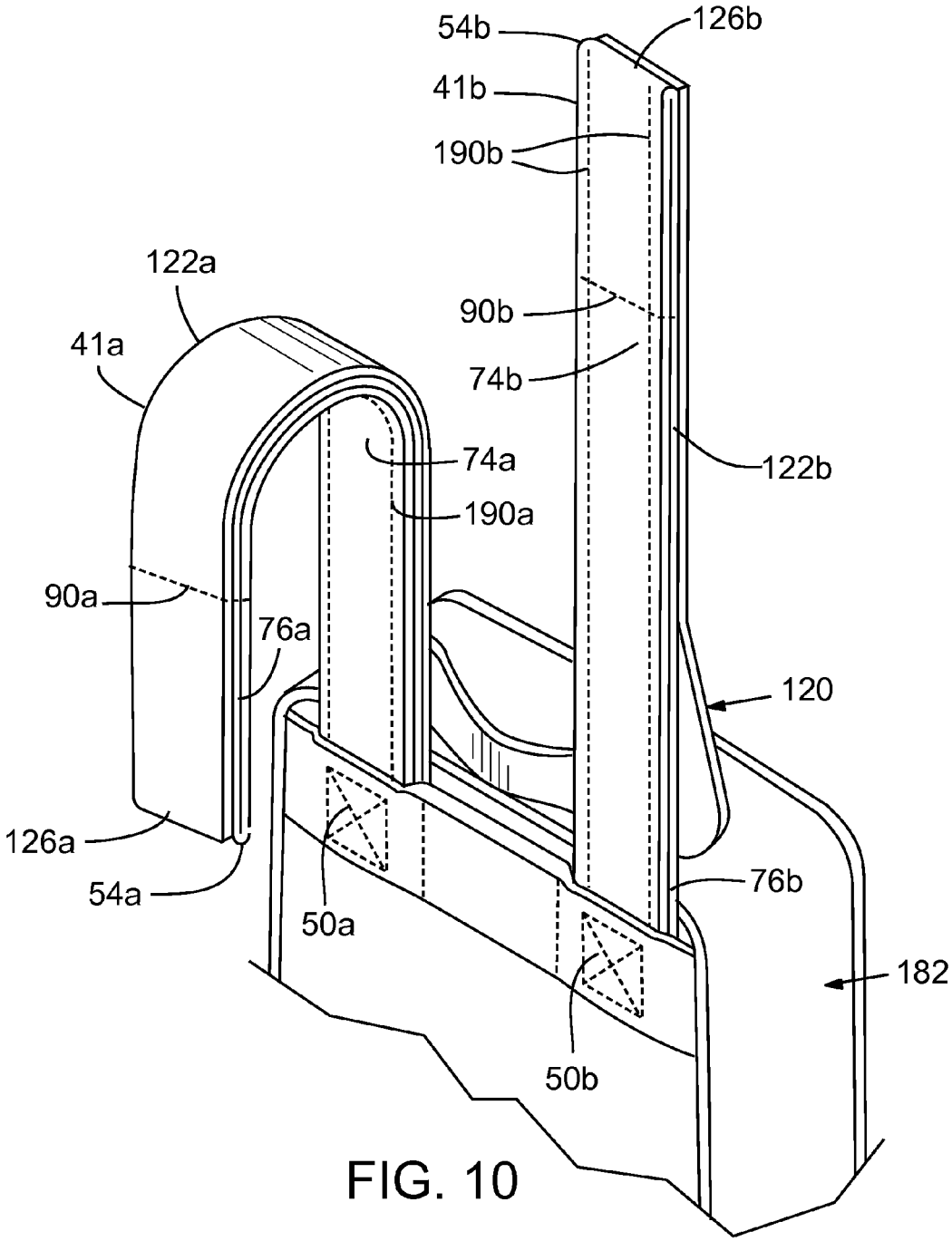
FIG. 10 is an isometric view of a top portion of a bag having quick-release connector straps and a pull handle segment, according to a fourth embodiment.

Referring to FIGS. 7 and 8, a quick-release connector strap assembly 70 is shown, according to one embodiment. The connector strap assembly 70 includes three segments, two connector straps 71*a* and 71*b*, and a third pull handle segment 69 interposed therebetween. The connector strap assembly 70 may be constructed from a single length of fabric as shown in FIG. 7, or, in other embodiments, the connector strap assembly 70 may be constructed from two or more pieces that are fused, welded, stitched, or bonded as shown in FIG. 10.

According to the embodiment of FIGS. 7 and 8, the quick-release connector strap assembly 70 is anchored to a bag 72 with the fastener stitching 50*a* and 50*b* (or simply "fasteners"). The connector straps 71*a* and 71*b* are formed with respective longitudinally extending subsegments 74*a* and 74*b*. The subsegment 74*a* (having a length of A and C as illustrated in FIG. 8) is of sufficient length to extend past the end-most securement strap 34*g* when the respective terminal ends 54*a* and 54*b* are extended for placement into the retaining member 64. The connector straps 71*a* and 71*b* are each folded over itself and extended back toward the respective fasteners 50*a* and 50*b* to form respective overlying subsegments 76*a* and 76*b* with sufficient length to extend past the first securement strap 34*a* when the respective terminal ends 54*a* and 54*b* are positioned to be tucked into the retaining member 64. First and second 90° corners 78*a* and 78*b* are formed in the connector strap assembly 70 to provide the pull handle segment 69 therebetween. The pull handle segment 69 extends laterally, parallel to a top surface (or panel) 80 of the bag 72, according to one embodiment.

The fasteners 50*a* and 50*b* retain connector strap assembly 70 to the bag 72. In another embodiment (not shown), the connector strap assembly 70 may be constructed from a single, untethered length of fabric, woven through loop channels as described above with respect to FIGS. 2A and 2B. In still another embodiment, only one fastener 50*a* or 50*b* is present such that an untethered portion of a connector strap may be folded on itself, i.e., doubled over to form a first connector strap that may be woven through a loop channel, the remaining portion extended laterally to form the pull handle segment 69, and folded again to form another connector strap.

In the example shown in FIGS. 7 and 8, the connector straps 71*a* and 71*b* of the connector strap assembly 70 include two overlapping layers of fabric. The terminal ends 54*a* and 54*b* are smooth, rounded folds that reduce snagging during insertion or removal of the connector straps 71*a* and 71*b* into loop channels, while also being resistant to fraying. A portion of the two overlapping layers may be optionally fused, stitched, or bonded together. For example, stitching 90*a* and 90*b* help to retain the pairs of subsegments 74*a*, 76*a*, and 74*b*, 76*b*, in conformal alignment for easier insertion of the connector straps 71*a* and 71*b*. Additionally, the stitching 90*a* and 90*b* may impart additional rigidity to connector straps 71*a* and 71*b*. In another embodiment, optional stiffeners, e.g., plastic tabs (not shown), may be sandwiched between respective confronting portions of the subsegments 74*a*, 76*a*, and 74*b*, 76*b*, in regions between the stitching 90*a*, 90*b* and the folded terminal ends 54*a*, 54*b*.

With reference to FIG. 8, the positioning of the stitching 90*a* in connector strap 71*a*, along with the location of the fastener 50*a*, the terminal end 54*a*, and the corner 78*a*, collectively define three connector strap segments having lengths A, B, and C. (Although not described herein, connector strap segments associated with the connector strap 71*b* are the same.) The first connector strap segment A includes a portion of the subsegment 74*a* affixed at an attached end 97*a* by the fastener stitching 50*a* and the opposing end extending to the stitching 90*a*. The second connector strap segment B includes a portion of the subsegment 76*a* connected to the stitching 90*a* and extending to the corner 78*a*. The third strap segment C is formed by portions of the subsegments 74*a*, 76*a* sewn or joined at the location of stitching 90*a* and extending to the distal end of the connector strap 71*a*, i.e., the terminal end 54*a*.

The relative lengths of the connector strap segments A, B, and C are selected so that when the connector straps 71*a* and 71*b* are interwoven, the pull handle segment 69 is readily graspable and the terminal ends 54*a* and 54*b* may be removed from the interlaced ladder of the securement straps 14 and 34 to release the bag 72 with a strong pull in a direction transverse to the plane of the top surface panel 80. Thus, the connector strap segments A, B, and C may vary depending on the following three criteria. First, the stitching 90*a* is positioned along the connector strap 71*a* such that the connector strap segments A and C that define the subsegment 74*a* have a cumulative length (A+C) that is greater than a distance D between the attached end 97*a* and the bottom-side 65 of the securement strap 34*g* (i.e., A+C>D). As described above, the length of the subsegment 74*a* permits the terminal end 54*a* to extend past the bottom-side 65 for positioning in the retaining member 64. Second, the stitching 90*a* is positioned along the connector strap 71*a* such that the connector strap segments B and C that define the subsegment 76*a* have a cumulative length (B+C) that is greater than a distance E between the two farthest sides of the securement straps 34*a* and 34*g* (i.e., B+C>E). The length of the subsegment 76*a* helps provide a readily graspable pull handle segment 69 that extends beyond a top-side 100 of the securement strap 34*a* when the connector strap 71*a* is interwoven. Third, the location of the attached end 97*a* and the top-side 100 of the securement strap 34*a* define a distance F therebetween. The connector strap segment A and the distance F have a cumulative length (A+F) that is approximately equal to or greater than a length C (i.e., A+F≧C) so that the terminal end 54*a* may be withdrawn and pulled beyond the top-side 100 of the securement strap 34*a*. In a typical embodiment, A>>F and C>>F, so therefore A≧C. The interrelation of the connector strap segments A, B, and C and the various interstrap distances D, E, and F can be expressed according to the following three equations:

$$A + B > D \qquad \text{Equation 1}$$

$$B + C > E \qquad \text{Equation 2}$$

$$A + F \geq C \qquad \text{Equation 3}$$

Figure 9:
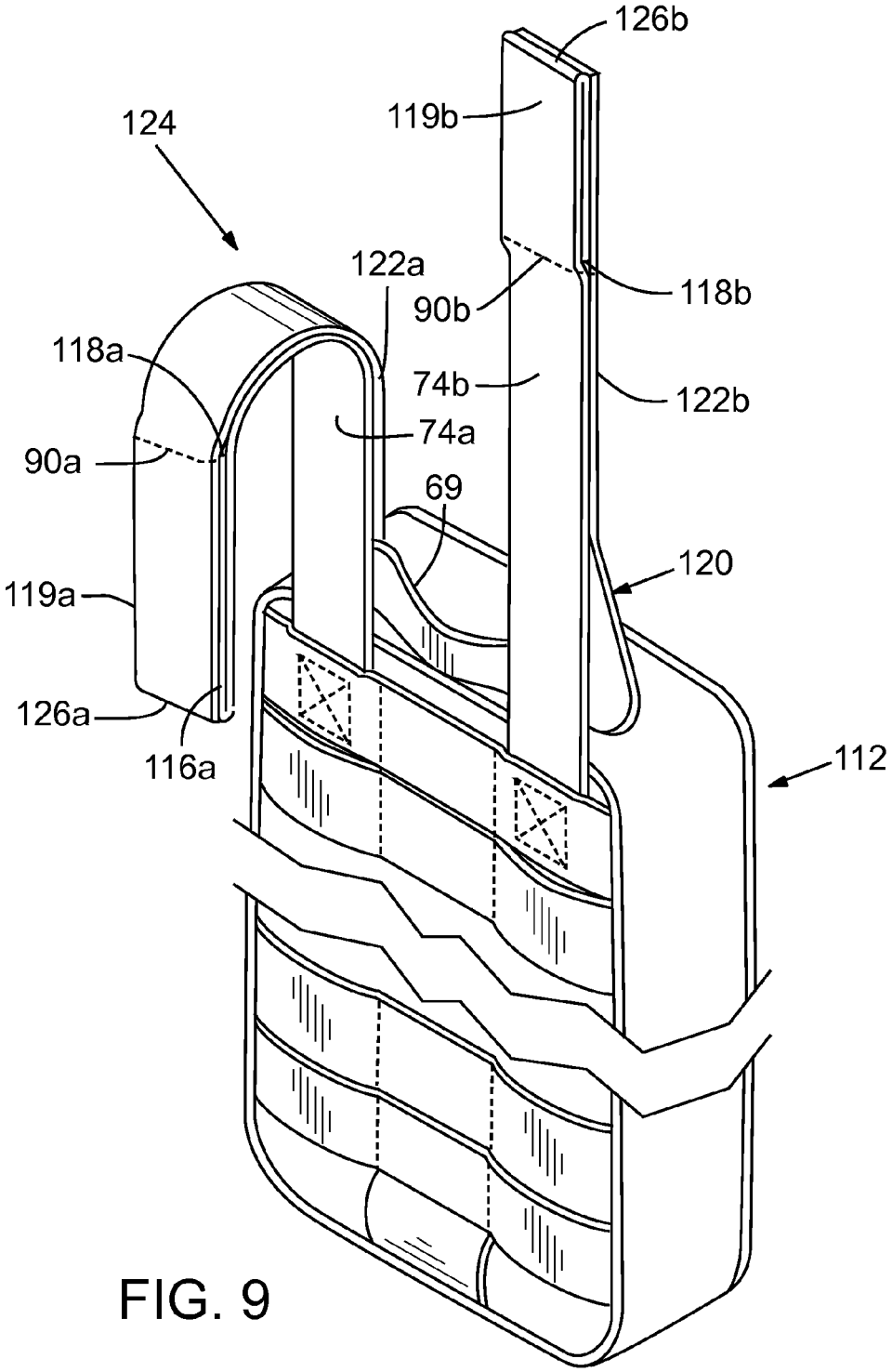
FIG. 9 is an isometric view of a bag having quick-release connector straps and a pull handle segment, according to a third embodiment.

In one embodiment (not shown), an additional stiffening layer may be inserted between layers of the connector straps 71*a* and 71*b*. In some embodiments, the stiffening layer may be stitched on an exterior surface of connector straps 71*a* and 71*b* as discussed with respect to FIGS. 9 and 10. FIG. 9 shows a bag 112 that is substantially similar to the embodiment of FIG. 7; however, subsegments 116*a* and 116*b* are shorter than the counterpart subsegments 76*a* and 76*b* shown in FIG. 7. The shorter subsegments 116*a* and 116*b* overlay the respective subsegments 74*a* and 74*b*, and have terminal ends 118*a* and 118*b* that do not extend to the fastener stitching 50*a* and 50*b*.

To prevent snagging of the terminal ends 118*a* and 118*b* and to provide a means to quickly release the connector straps 119*a* and 119*b*, the pairs of subsegments 74*a*, 76*a* and 74*b*, 76*b* are covered with a cover assembly 120. The cover assembly 120 includes cover strip segments 122*a* and 122*b*, and the pull handle segment 69 interposed therebetween. The cover assembly 120 and the connector straps 119*a* and 119*b* form a strap assembly 124. Terminal ends 126*a* and 126*b* of respective cover strip segments 122*a* and 122*b* are heat cut (i.e., melted and rehardened) and aligned with terminal ends 54*a* and 54*b* so that the rehardened portions ease insertion of connector straps 119*a* and 119*b* into loop channels. The cover strips 122*a* and 122*b* are attached to the underlying pairs of subsegments 74*a*, 76*a* and 74*b*, 76*b* with the respective stitching 90*a* and 90*b*, forming connector strap segments similar to the connector strap segments A, B, and C described previously.

With respect to the bag 112 of FIG. 9, the connector strap segment A (not shown) includes a portion of the subsegment 74*a* affixed at an attached end 97*a* by the fastener stitching 50*a* and the opposing end terminating at the stitching 90*a*. The second connector strap segment B of the bag 112 (not shown) includes a portion of the cover strip 122*a* connected to the stitching 90*a* and terminating at the corner 78*a*. The third strap segment C of the bag 112 (not shown) is formed by portions of the subsegments 116*a*, 74*a* and the cover strip 122*a* sewn or joined at the location of stitching 90*a* and extending to the distal end of the connector strap 119*a*, i.e., the terminal ends 54*a* and 126*a*. Thus, the strap segment C includes a portion of the cover strip 122*a* that overlies the subsegment 116*a*, while the subsegment 116*a* confronts an underlying portion of the subsegment 74*a*.

In another embodiment shown in FIG. 10, the bag 182 has a cover assembly 120 substantially similar to that of the bag 112. However, unlike the bag 112, the bag 182 includes the longer subsegments 76*a* and 76*b* that extend to the respective fasteners 50*a* and 50*b*, and are conformally sewn to the respective subsegments 74*a* and 74*b* with longitudinal stitching 190*a* and 190*b*.

Referring back to FIGS. 1B, 2A, 2B, and 3-6, the bag 12 has a cover assembly 200 of similar construction as described above with respect to the bag 182, i.e., the subsegments 76*a* and 76*b* extend to the respective fasteners 50*a* and 50*b*. The stitching 90*a* and 90*b* is positioned approximately at the midpoint along the length of the connector straps 41*a* and 41*b* in a manner that satisfies Equations 1-3, above. The cover assembly 200 and the connector straps 41*a* and 41*b* form a strap assembly 205.

Figure 11:
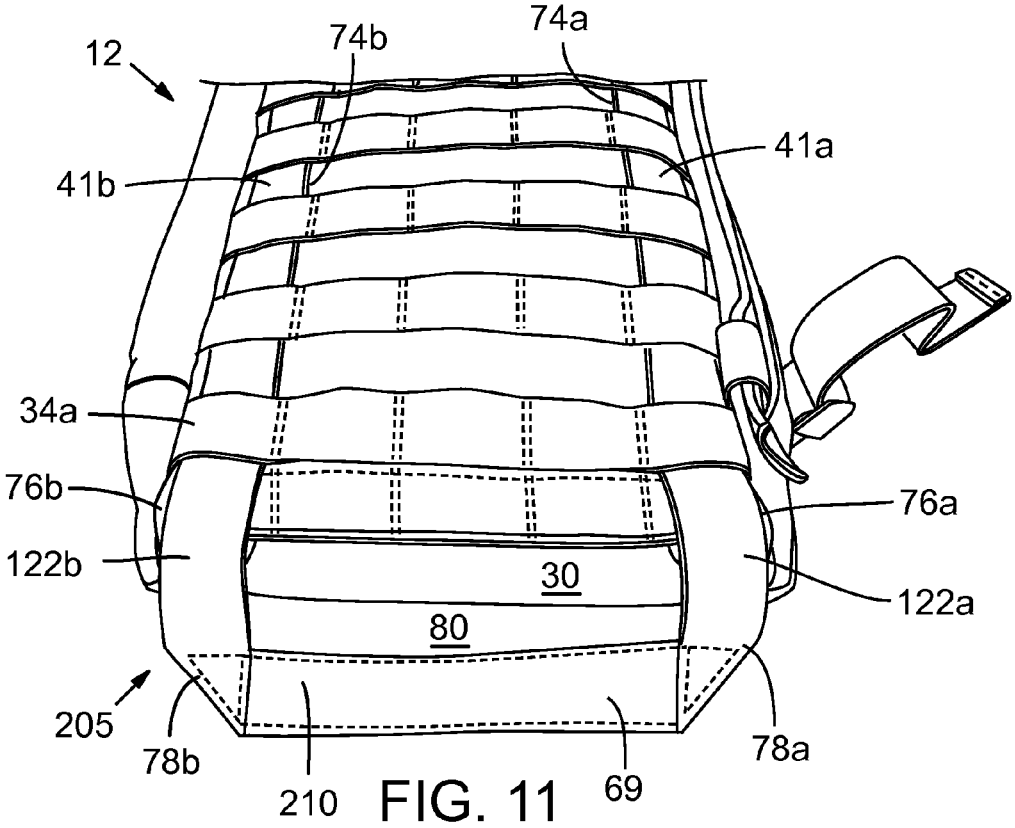
FIG. 11 is an enlarged perspective view of the rear and top panel surfaces of the medical chest bag as shown in FIG. 1B, showing details of the pull handle segment.
Figure 12:
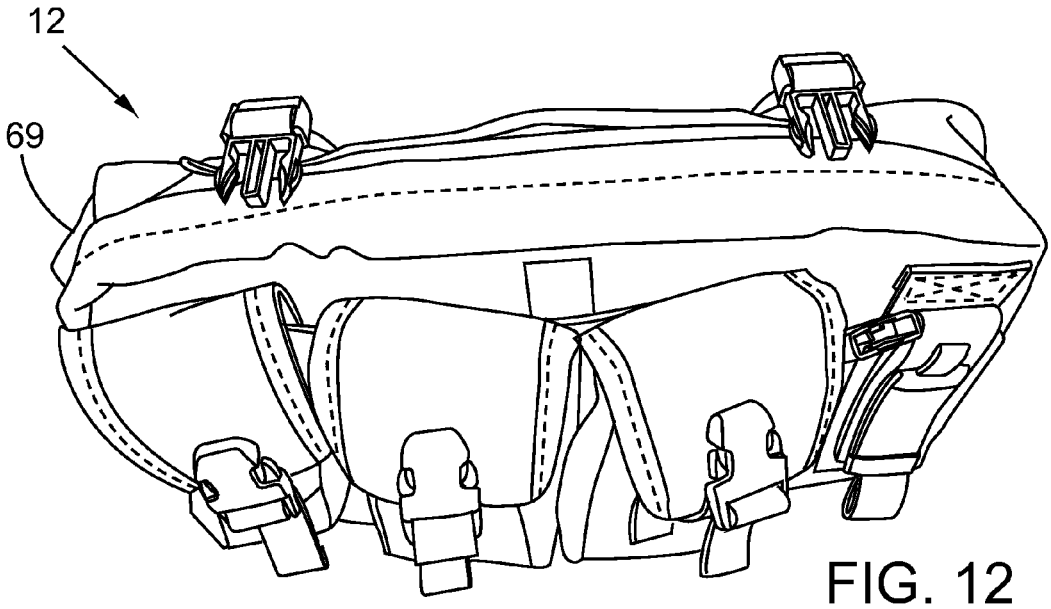
FIG. 12 is a perspective view of a front panel of the medical chest bag shown in FIG. 1B, depicting modular pouches attached thereon.

FIG. 11 is an enlarged perspective view of the pull handle segment 69 of the bag 12. The pull handle segment 69 includes a single layer (not visible) as described with reference to FIG. 7, and a backing or reinforcement strip 210 stitched or fused onto a major surface of the pull handle segment 69. The first and second corners 78*a* and 78*b*, proximal to distal ends of the pull handle segment 69, are tacked with a half-box stitch to form the readily graspable pull handle 69. A user or wearer of the bag 12 attached to a support article 8 can readily grasp the pull handle segment 69, pull in a single direction transverse to the plane of the top surface panel 80, and thereby draw the connector straps 41*a* and 41*b* out to release the bag 12 from the supporting article 8.

It will be obvious to those having skill in the art that many changes may be made to the details of the above-described embodiments without departing from the underlying principles of the invention. The scope of the present invention should, therefore, be determined only by the following claims.

The invention claimed is:

1. A portable article configured to be releasably secured to a support surface having multiple elongate and flexible first securement straps fastened to the support surface in a spaced-apart manner such that the first securement straps are positioned in parallel with respect to one another and define, on the support surface, elongate gaps therebetween, each of the first securement straps forming a first loop along its length, the first loops of adjacent ones of the first securement straps being aligned to cooperatively form a first column of securement loops oriented perpendicular to the lengths of first securement straps, the portable article comprising:

a panel;

multiple elongate and flexible second securement straps including first and second endmost securement straps, the second securement straps fastened to the panel in spaced-apart relation so that, when the portable article is disposed with the panel in confronting relation to the support surface, the second securement straps confront corresponding ones of the elongate gaps for securement of the portable article to the support surface, each of the second securement straps forming a second loop along its length, the second loops of adjacent ones of the second securement straps being aligned to cooperatively form a second column of securement loops oriented perpendicular to the lengths of the second securement straps, the second loops of the second column being positioned for interlacing with the first loops of the first column to cooperatively form a loop channel when the portable article is disposed with the panel confronting the support surface;

an elongate and flexible connector strap comprising:

a first segment having an end portion fastened to the panel at a fastened location proximate the first endmost securement strap;

a second segment conformable to the first segment such that a portion of major surfaces of the first segment and second segment overlap when the connector strap is extended through the loop channel, the second segment joined to the first segment at a joined location on the first segment located away from the first endmost securement strap, and the second segment extending to a pull portion that, when pulled away from the first endmost securement strap, causes the connector strap to be withdrawn from the loop channel and release the portable article from the support surface; and a retaining pouch having an opening to receive a distal portion of the connector strap along an insertion axis that extends in a direction transverse to an axis defined by the loop channel.

2. The portable article of claim 1, wherein the first and second segments are joined by a fold of the connector strap.

3. The portable article of claim 1, wherein the connector strap is constructed from a contiguous piece of webbing.

4. The portable article of claim 1, wherein the connector strap comprises a first connector strap, the portable article further comprising:

a second connector strap; and a pull handle spanning between pull portions of each connector strap, the pull handle positioned parallel to the first endmost securement strap when the connector straps are extended through corresponding interlaced loop channels, and the pull handle including a graspable portion configured to be pulled when the portable article is secured to the support surface to simultaneously withdraw each connector strap from its corresponding interlaced loop channel.

5. The portable article of claim 4, wherein the pull handle and the connector straps are constructed from a contiguous piece of webbing.

6. The portable article of claim 1, wherein the first segment has a first length extending from the joined location to the fastened location, the second segment being joined to the first segment by stitching forming a third segment having a third length extending from the joined location to the distal portion of the connector strap, and the sum of first and third lengths being greater than a distance measured from the fastened location to a far side of the second endmost securement strap that is located away from the fastened location.

7. The portable article of claim 1, wherein the second segment is joined to the first segment by stitching forming a third segment having a third length extending from the joined location to the distal portion of the connector strap, the third length being less than or equal to a distance measured from the first endmost securement strap to the joined location when the strap is fully withdrawn from the loop channel and extended away from the panel.

8. The portable article of claim 1, wherein the first segment has a first length extending from the joined location to the fastened location, the second segment being joined to the first segment at a location forming a third segment having a third length extending from the joined location to the distal portion of the connector strap, and the first length is greater than the third length.

9. The portable article of claim 1, wherein the securement straps and the connector strap are formed from a flexible fabric material secured to the panel or to the support surface by stitching.

10. The portable article of claim 9, wherein the flexible fabric material comprises a webbing material.

11. The portable article of claim 1, wherein the securement straps are spaced-apart in accordance with a pouch attachment ladder system.

12. The portable article of claim 1, wherein the distal portion of the connector strap includes a melted and rehardened portion.

13. The portable article of claim 1, wherein the connector strap includes a stiffener layer between the first and second segments.

14. The portable article of claim 1, wherein the opening is positioned to receive the distal portion and produce a raised elbow in the connector strap in response to insertion of the distal portion into the opening.

15. The portable article of claim 1, wherein the second segment has a second length extending from the joined location to the pull portion, the second segment being joined to the first segment by stitching forming a third segment having a third length extending from the joined location to the distal portion of the connector strap, the sum of the second and third lengths being greater than a distance defined by farthest sides of the first endmost securement strap and a second endmost securement strap.

16. A quick-release strap attachment system for releasably securing a removable article to a support surface, the removable article having a panel, the system comprising:

first securement straps attached to the support surface in spaced-apart relation and forming a first column of loops oriented transversely to lengths of the first securement straps;

second securement straps attached to the panel of the removable article in spaced-apart relation and forming a second column of loops oriented transversely to lengths of the second securement straps, the second securement straps spaced-apart so that, when the removable article is disposed with the panel confronting the support surface, the second securement straps are interlaced with first securement straps and the first and second columns of loops cooperatively form a loop channel;

an elongate and flexible connector strap comprising:

a first segment extending from a joined location to an end portion fastened to the panel proximate a first endmost securement strap of the second securement straps; and a second segment conformable to the first segment such that a portion of major surfaces of the first segment and second segment overlap when the connector strap is extended through the loop channel, and the second segment extending from the joined location to a pull portion that, when pulled away from the first endmost securement strap, causes the connector strap to be withdrawn from the loop channel and release the removable article from the support surface; and a retaining pouch having an opening to receive a distal portion of the connector strap along an insertion axis that extends in a direction transverse to an axis defined by the loop channel.

17. The system of claim 16, wherein the first segment comprises third and fourth segments formed from a contiguous piece of webbing joined at the distal portion of the connector strap.

18. The system of claim 17, wherein the second segment overlaps the fourth segment when the connector strap is extended through the loop channel.

19. The system of claim 16, wherein the second segment is heat cut at the distal portion of the connector strap.

20. The system of claim 16, wherein:

the first segment has a length A extending from the joined location to a fastened location proximate the first endmost securement strap, the second segment being joined to the first segment at the joined location to form a third segment having a length C extending from the joined location to the distal portion, and the length A is greater than the length C;

the second segment has a length B extending from the joined location to the pull portion so that the sum of the lengths B and C are greater than a distance E defined by farthest sides of the first endmost securement strap and a second endmost securement strap; and the length C being less than or equal to a distance measured from the side of the first endmost securement strap to the joined location when the strap is fully withdrawn from the loop channel and extended away from the panel.

* * * * *